United States Patent [19]

Hanson et al.

[11] Patent Number: 4,673,324

[45] Date of Patent: Jun. 16, 1987

[54] METHOD AND SHEET FOR BINDING PAGES

[75] Inventors: Gary R. Hanson; George R. Rabuse, both of St. Paul, Minn.

[73] Assignee: Minnesota Mining and Manufacturing Company, St. Paul, Minn.

[21] Appl. No.: 864,527

[22] Filed: May 19, 1986

[51] Int. Cl.[4] ..... B42B 5/00; B42C 9/00; B42F 1/00

[52] U.S. Cl. ..... 412/6; 156/227; 156/908; 281/21 R; 412/8; 412/901

[58] Field of Search ..... 281/21 R, 29, 34, 35; 412/4, 6, 8, 7, 900, 901; 156/90, 227, 291, 486, 588, 908

[56] References Cited

U.S. PATENT DOCUMENTS

| | | | |
|---|---|---|---|
| 848,680 | 4/1907 | Nelson . | |
| 1,765,194 | 6/1930 | Von Auw . | |
| 1,913,969 | 6/1933 | Wood . | |
| 2,014,305 | 9/1935 | Alger . | |
| 2,455,971 | 12/1948 | Bosch | 412/27 X |
| 3,088,754 | 5/1963 | Burgmer | 282/22 |
| 3,179,967 | 4/1965 | Yohn et al. | 11/1 |
| 3,188,114 | 6/1965 | O'Brien et al. | 281/21 |
| 3,206,225 | 9/1965 | Oleson | 281/29 |
| 3,210,093 | 10/1965 | Steidinger | 281/21 |
| 3,825,963 | 7/1974 | Abildgaard et al. | 11/1 |
| 3,833,244 | 9/1974 | Heimann | 281/21 |
| 3,995,886 | 12/1976 | Staats | 156/277 X |
| 4,007,950 | 2/1977 | Giulie | 281/25 |
| 4,106,148 | 8/1978 | Axelrod | 11/1 |
| 4,129,471 | 12/1978 | Rome | 156/277 X |
| 4,213,220 | 7/1980 | Lopez-Martinez | 11/1 |
| 4,266,812 | 5/1981 | Staats | 412/900 X |
| 4,447,481 | 5/1984 | Holmberg | 428/40 |
| 4,511,298 | 4/1985 | Jones | 412/34 |
| 4,518,296 | 5/1985 | Pearson et al. | 412/37 |
| 4,558,888 | 12/1985 | Hanson et al. | 281/1 X |
| 4,562,102 | 12/1985 | Rabuse et al. | 156/90 X |
| 4,590,109 | 5/1986 | Holmberg | 428/40 |

FOREIGN PATENT DOCUMENTS

| | | | |
|---|---|---|---|
| 0110237 | 6/1984 | European Pat. Off. . | |
| 2815649 | 10/1979 | Fed. Rep. of Germany . | |
| 1382574 | 11/1964 | France | 281/21 R |
| 6711263 | 2/1969 | Netherlands | 281/21 R |

*Primary Examiner*—Paul A. Bell

*Attorney, Agent, or Firm*—Donald M. Sell; James A. Smith; John C. Barnes

[57] ABSTRACT

A sheet for binding loose pages together in pamphlet form comprises a thin flexible sheet having a band of pressure sensitive adhesive coated along one longitudinal edge and protected by a release liner. The sheet permits binding the sheets easily by hand.

13 Claims, 17 Drawing Figures

METHOD AND SHEET FOR BINDING PAGES

BACKGROUND OF THE INVENTION

1. Field of the Invention

The present invention relates to a prepared sheet and process for binding a plurality of loose pages of the same size together, and in one aspect, comprises a sheet corresponding to the pages to be bound in size with an extended adhesive coated edge which serves to bind the pages together along offset or shingled edges of the pages.

2. Description of the Prior Art

The binding sheet of the present invention is adapted to replace various binding systems for a plurality of pages, up to about 30 pages. Prior binding systems for a small number of pages comprised staples, loose-leaf binders, mechanical fasteners, i.e., paper clips, prongs and fasteners as sold by Acco International Inc., Chicago, Ill. 60630, paper fasteners and washers as sold by Swingline, Inc., Long Island City, N.Y. 11101, plastic rivets, pins, slide strip binders and other jackets with built-in prongs for retaining sheets. Binding by the use of preformed covers having a hot melt adhesive requires a mechanism or tool for effecting the binding operation and therefore is not considered relevant. The shingling of sheets to expose a marginal portion of each sheet and binding them together by the use of adhesive contacting the edge of each sheet is known in the prior art. Such a binding method is taught by U.S Pat. No. 1,765,194, and 2,455,971.

The assignee of this application has several patents for tape products incorporating pressure sensitive adhesive for use in binding sheets together, i.e., U.S. Pat. Nos. 4,558,888, 4,562,102, and 4,518,296, directed to an apparatus for use in binding sheets together with the sheets disposed with the adjacent edges shingled.

The present invention provides a single sheet which may be utilized to bind a plurality of sheets or papers together without the use of tools or fixtures. The sheet consists of a back cover with a band of pressure-sensitive adhesive coated on one surface of the cover along one edge and a release liner is provided over the adhesive to protect the same prior to the binding operation.

The plurality of pages bound together by the binding sheet reduces the storage space required and provides a very lay-flat binding for the pages.

SUMMARY OF THE INVENTION

The present invention is directed to a sheet for use in binding a plurality of pages together. The binding sheet comprises a thin flexible sheet adapted to form the back cover for the bound pages, which back cover has a length dimension at least equal to that of the pages to be bound and a width which exceeds the width of the pages to be bound and one longitudinal edge of the sheet is provided with a coating of pressure-sensitive adhesive positioned along the marginal edge of the sheet. The adhesive is in contact with a release coating to protect the adhesive until the sheet will be used for binding. The length of the binding sheet should be at least equal to the length of the pages to be bound and the sheet width ($S_w$), as a minimum, should be equal to the page width plus the product of Pi($\pi$) times the thickness, of the pages to be bound times the maximum number or a predetermined number of pages to be bound, added to the width of the marginal edge of the sheet which will overlap the front page of the pages to be bound. Thus the minimum sheet width ($S_w$) is given by the formula $$S_w = P_w + \pi t N_{Max} + T_{po}$$

where:

$P_w$ = page width t = page thickness $N_{Max}$ = maximum number of pages to be bound by the sheet or a predetermined number $T_{po}$ = the minimum overlap of the adhesive on the marginal edge of the top sheet when binding the maximum number of pages.

The sheet stiffness at the adhesive area should equal $6\times10^{-3}$ to $5\times10^{-5}$ by the flexural rigidity test, useful methods test No. 409 of TAPPI standards, the description of which is incorporated herein by reference. A suitable adhesive for use with the binding sheet is an adhesive which has good initial adhesion. This can be measured by the "Quick Stick" test 5 of the PSTC (Pressure Sensitive Tape Council). The preferred adhesive is a normally tacky and pressure-sensitive copolymer of iso-octyl acrylate and acrylic acid in a 95.5:4.5 ratio as described in Ulrich's U.S. Pat. No. Re 24,906.

DESCRIPTION OF THE DRAWING

The present invention will be described with reference to the accompanying drawing wherein.

DESCRIPTION OF THE PREFERRED EMBODIMENTS

Figure 1:
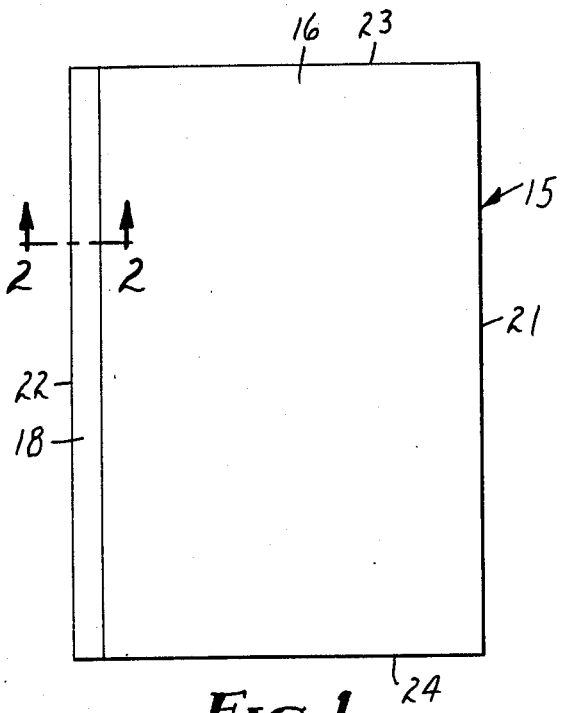
FIG. 1 is a plan view of the sheet for binding pages together.

Referring now to the drawing, FIG. 1 illustrates a backing or binding sheet 15 useful for binding pages together according to the present invention. This binding sheet comprises a sheet 16 of thin flexible material having a length at least equal to the length of the sheets to be bound and a width which exceeds the width of the sheets to be bound. A layer of pressure-sensitive adhesive 17 is coated on one surface of the sheet 16 along one longitudinal edge at the margin of the sheet. A release liner 18, preferably with printed instructions thereon, is positioned over the layer of adhesive 17 to protect the same.

The sheet 16 can be a sheet of 20 pound Bond paper having a thickness of between 0.0036 to 0.0046 inch. The paper products will have the desired flexibility, i.e., the sheet material should be stiff enough not to wrinkle and yet supple enough to fold when the top sheet of the bound pages are folded back upon the stack as will be further explained in discussing the process. A flexural rigidity of between $6\times10^{-3}$ and $5\times10^{-5}$ according to the Technical Association of the Pulp and Paper Industry (TAPPI) useful methods test No. 409 produces the desired results. The sheet will fold along the edge of the top page and retain a crease at the edge of the top page. Other materials such as polymeric films can be utilized as the sheet 16 but they again must have a flexural rigidity in the adhesive coated area which permits this folding and creasing without damage to the bound documents.

The sheet 16 preferably has a length which is at least equal to the length of the sheets to be bound, having two longitudinal marginal edges 21 and 22. The width of the sheet must be greater than the width of the individual pages to be bound and the sheet is formed with a top edge 23 and a bottom edge 24. The minimum width of the sheet 16 ($S_w$) is given by the formula $$S_w = P_w + \pi t N_{Max} + T_{po}$$

where:

$P_w$=width of page to be bound t=thickness of the page to be bound $N_{Max}$=maximum number of pages to be bound on the sheet $T_{po}$=the minimum overlap of the adhesive on the marginal edge of the top page when binding the maximum number of pages.

The adhesive 17 which is coated along the longitudinal marginal edge 22 on one side of the sheet 16 preferably has the same length along the marginal edge as the pages to be bound on the sheet. If the sheet has the same length as the pages to be bound, then the adhesive runs the entire length of the marginal edge 22. The adhesive width ($A_w$) is given by the following formula:

$$A_w = \pi t (N_{Max} + 1)\ T_{po}$$

where:

$A_w$=adhesive binding width t=thickness of the page to be bound $N_{Max}$=maximum number of pages to be bound on the sheet $T_{po}$=the minimum overlap of the adhesive on the marginal edge of the top page when binding the maximum number of pages.

A specific example of a binding sheet for binding 25 pages of paper 0.005 inch thick, 8.5 inches by 11 inches in dimension corresponding to conventional office stationery in the United States is:

cover length=at least 11 inches adhesive length=11 inches $T_{po}$=at least 0.125 inch adhesive width=at least 0.533 inch cover width=at least 9.033 inches Another example of a binding sheet for binding 25 pages of paper 0.127 mm thick, 21 cm by 29.5 cm, corresponding to conventional A-4 office stationery, is:

cover length=at least 29.5 cm adhesive length=29.5 cm $T_{po}$=at least 0.32 cm adhesive width=at least 1.35 cm cover width=at least 22.35 cm The adhesive may be most conveniently supplied by applying a strip of adhesive carried by a release liner, which adhesive may be applied to the length of the sheet 16 along the edge 22 on one side thereof. The adhesive 17 is preferable applied by coating a narrow band of a web of sheet stock along the central portion. Applying a release liner to the coating of adhesive after it dries and then slit the web at its midpoint and then cut the sections to sheets.

The adhesive 17 preferably has good initial adhesion to the pages to be bound. The initial adhesion of the adhesive is measured by the "Quick Stick" test number 5 of the PSTC (Pressure Sensitive Tape Council) to be greater than 8 ounces per 0.5 inch of width of the adhesive and greater than 12 ounces per 0.5 inch of width of the adhesive is preferred.

One example of the adhesive is a normally tacky and pressure-sensitive copolymer of iso-octyl acrylate and acrylic acid in a 95.5:4.5 ratio as described in Ulrich's U.S. Pat. No. Re 24,906.

The release liner 18 is generally a strip of Kraft paper coated on one side with a low adhesion coating to permit release of the liner from the adhesive. Removal of the liner 18 thus exposes the band or strip of adhesive 17 such that the sheet may be used for binding a plurality of pages 20 together by adhering one longitudinal edge of each said page to the adhesive strip 17.

Figure 3:
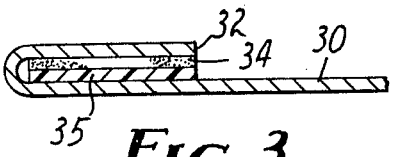
FIG. 3 is a fragmentary detail sectional view showing an embodiment without a liner.
Figure 2:
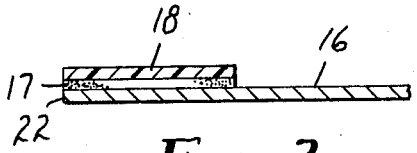
FIG. 2 is a fragmentary transverse sectional view taken along the lines 2—2 in FIG. 1.

FIG. 3 shows a sheet 30 having an edge 32 and the sheet has a coating 34 of a pressure sensitive adhesive applied on one marginal surface adjacent the edge 32. A coating 35 of a low adhesion material, e.g., silicone, is coated on the sheet 30 adjucent the coating 34 and the sheet 30 is folded to apply the adhesive coating temporarily against the release coating 35 until the sheet is to be used.

Figure 4:
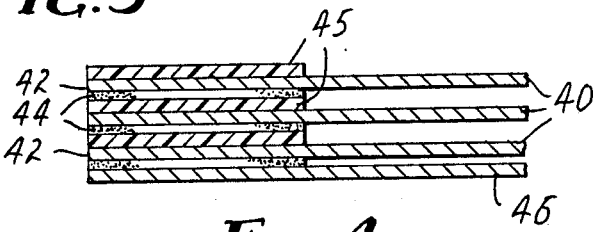
FIG. 4 is a fragmentary detail sectional view of a pad of sheets formed according to the present invention.

FIG. 4 illustrates a pad of binding sheets 40 each with a coating 44 of adhesive adjacent on edge 42. The sheets 40 also are provided with a coating 45 of low adhesion material on the surface of the sheet opposite the coating of pressure sensitive adhesive 44. This permits the sheets 40 to be stacked on a backing 46 to form a pad or tablet of binding sheets. The backing 46 will have a release surface to permit use of all the sheets 40 in the pad to bind a number of pages together into a booklet.

Figure 7:
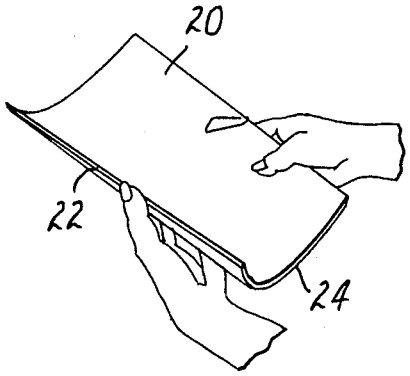
Figure 8:
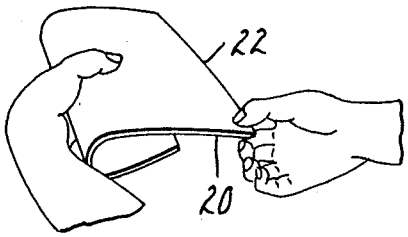
Figure 9:
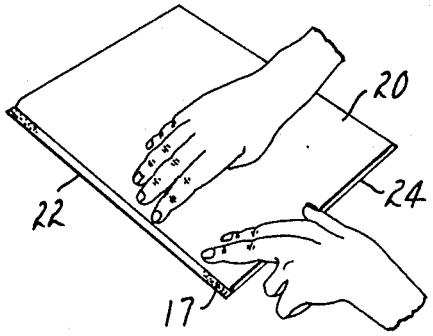
Figure 10:
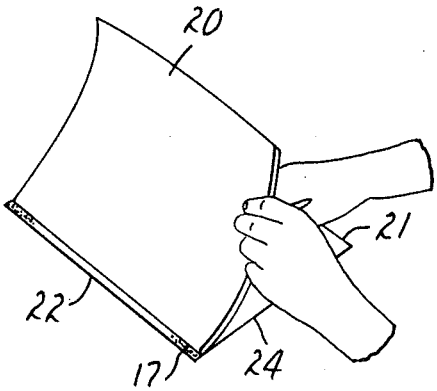
Figure 11:
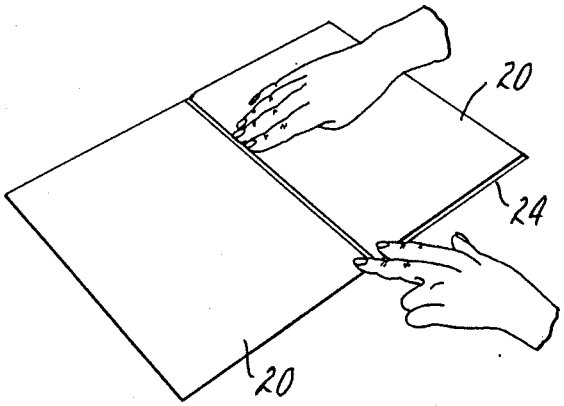
Figure 12:
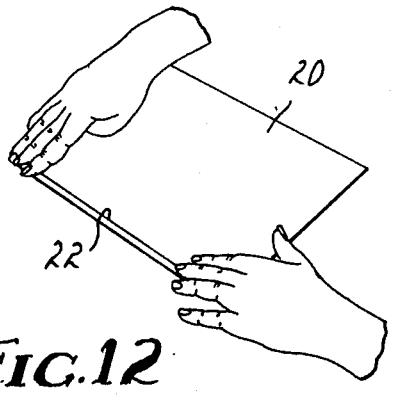

To afford the binding of the pages to the adhesive, reference is now made to FIGS. 5 through 12 which illustrate removal of the liner 18 from the narrow band of adhesive 17 for exposing the adhesive. The pages 20 are then placed against the surface of the sheet 16 which is coated with the adhesive along one marginal edge. The sheet 16 and the pages 20 are then jogged to align the same along the edge 21 of the sheet 16. The pages 20 and sheet 16 are then clamped at the edge 21 of the sheet 16. As illustrated in FIG. 7, the pages 20 and the sheet 16 are then rolled or folded with the pages 20 and the sheet 16 still clamped along the edge 21 to bring the opposite edge 22 of the sheet 16 and the edges of the pages to be bound over the clamped edge. This step shingles the edges of the pages to be bound. The shingled edges of the pages 20 and the edge 22 of the sheet 16 are then pressed together to press the shingled edges of the sheets 20 into contact with the strip of adhesive 17, as illustrated in FIG. 8. The pages and the sheet 16 are then layed flat and the edges again pressed into contact with the adhesive 17 along the edge 22. The top page of the pages 20 is then raised in an opening or page turning motion from the stack of pages and the same is folded over the edge 22 to be in a planar position with the sheets, as illustrated in FIG. 11. The top page is then pressed into contact with the adhesive 17 along the marginal edge 22. This top page 20 is then folded back onto the stack of pages, folding the sheet 16 adjacent the edge 22. A crease is then made along the marginal edge of sheet 16 where the adjacent edge of the top page of the bound pages lies with respect to the remaining pages. The creasing of this edge is illustrated in FIG. 12.

Figure 13:
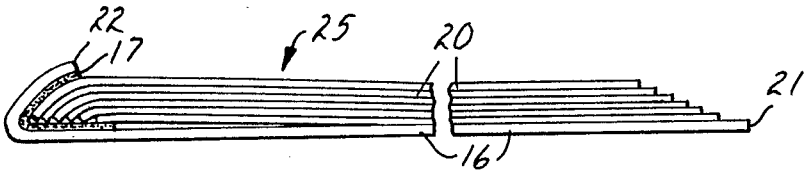
FIG. 13 is a detailed side elevational view of a number of pages bound together by the sheet.
Figure 5:
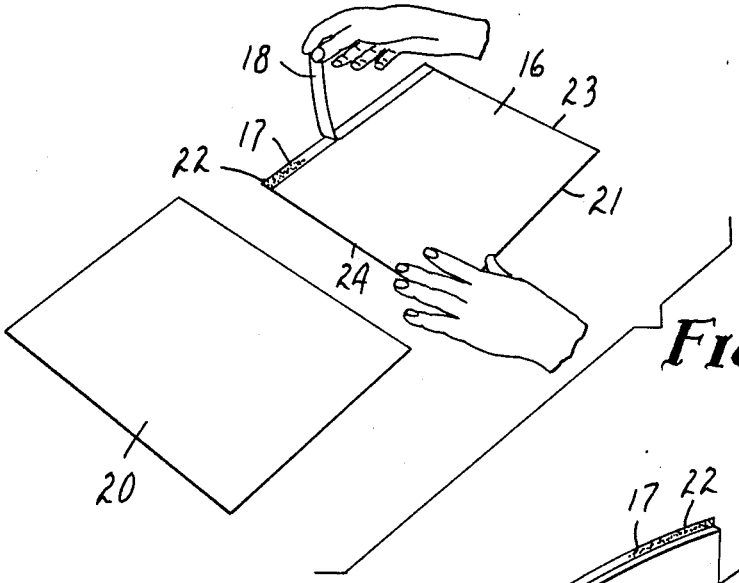
FIGS. 5 through 12 disclose the steps of binding pages together using the binding sheet of FIG. 1.
Figure 6:
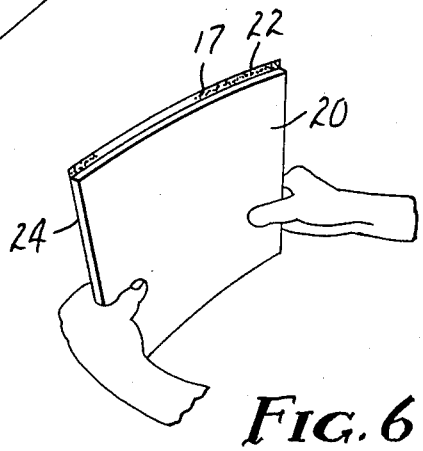

The resulting bound document 25 is diagrammatically illustrated in FIG. 13 in the exploded schematic diagram. As shown, the sheet 16 has a marginal portion folded over the edge of the top page 20. The top page is joined to the sheet 16 along the edge and top marginal edge surface. The bottom page is adhered along a marginal edge surface to the adhesive 17 and the pages between the bottom page (last page) and the top page (first page) have a marginal edge surface adhered by the adhesive 17 to the sheet 16. As these pages are opened to a lay-flat position the adhesive 17 maintains a bond between the edge of the pages and the sheet 16.

Figure 14:
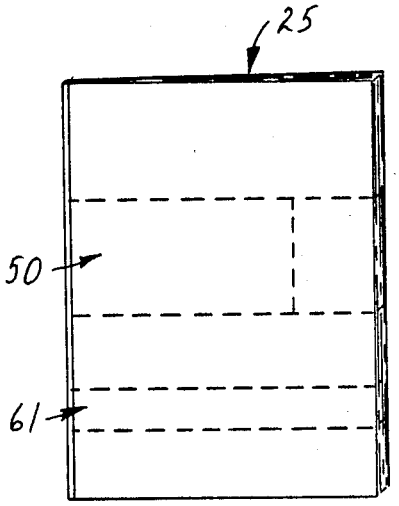
FIG. 14 is a plan view of a bound document like that illustrated in FIG. 13.
Figure 15:
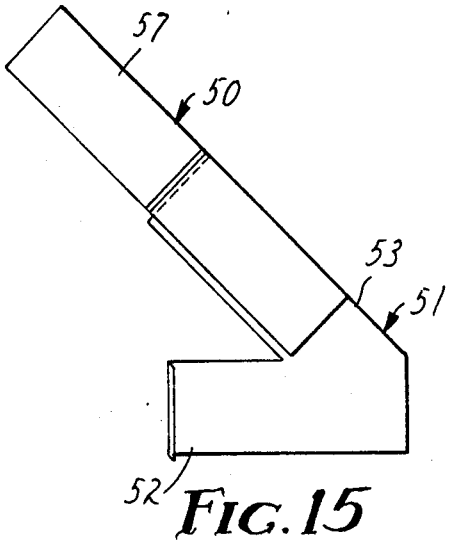
FIG. 15 is an elevational view of a test fixture.
Figure 16:
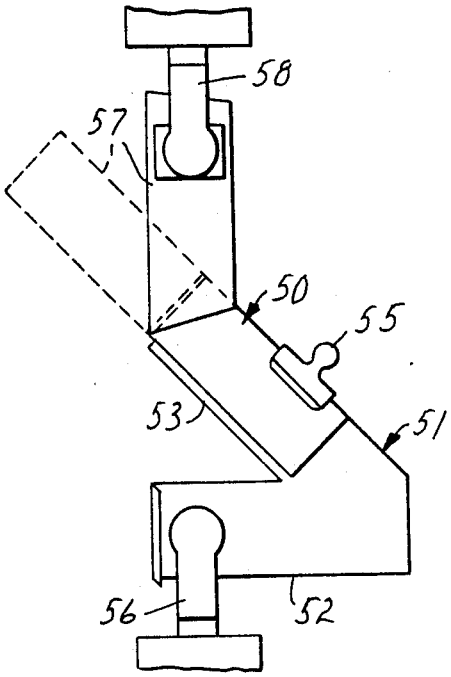
FIG. 16 is a fragmentary elevational view of a test device and the fixture.
Figure 17:
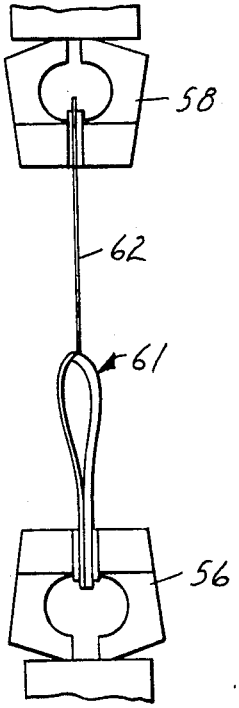
FIG. 17 is a fragmentary elevational view of a further test position.

A document can be tested to determine whether the adhesive used provided an adequate binding for the sheets. The following test was established to assess the shear strength of a page to the binding tape when removed at a 45° angle. Referring to FIGS. 14, 15 and 16 the test is conducted as follows: Using a paper cutter or guillotine the document or booklet illustrated in FIG. 13 is first cut to provide a section 50 of the booklet 3 to 4 inches wide at the bound edge and 6 inches long. This cut section is then placed by a clamp 55 on a fixture 51 illustrated in FIG. 15, which fixture comprises a horizontally disposed portion 52 and an angled portion 53 disposed at about 45° to the horizontally disposed portion 51. The document sample is opened to expose the third sheet and the remaining pages and the sheet 16 are then clamped along the upper marginal edge of the angled portion. The horizontal portion 52 is then placed in the lower jaw 56 of an Instron tensile tester, available from Instron Corp. of Canton, Mass., and the free end 57 of the third sheet is clamped in the upper jaw 58 of the Instron tensile tester. The first and second sheets 59 are allowed to extend past the fixture portion 53. The Instron equipment is then calibrated to provide a crosshead speed of ten (10) inches per minute, the chart length is set for ten (10) inches per minute, the gauge length is set to ten (10) inches, and the operator should use the Gram Cell at 1000 grams full scale. Jaw separation is then initiated as shown in FIG. 15 and the test results from the chart are recorded. Similar tests can be conducted with the sixth, ninth sheet, etc. An acceptable average value for this test of a booklet would be at least 40 grams with at least 70 and above being preferred.

Another test method is a 180° shear test to establish whether the adhesive 17 has sufficient shear strength to a document page. This test is done on an Instron tensile tester after preparation of a booklet sample 61 as illustrated in FIG. 14 wherein a one (1) inch wide sample is cut from the finished booklet 25, after placing the top front page of the sample toward the operator the third strip 62 from the sample is positioned in the top jaw 63 of the Instron tensile tester and all of the remaining strips in the bottom jaw 65. Then calibrate the test equipment with a crosshead speed of 5 inches per minute, chart speed at 10 inches per minute, gauge length at 5 inches and use the Gram Cell at 1000 grams full scale. Then initiate jaw separation and record the force to break the bond. This test can be repeated for the sixth, ninth or twelfth sheet etc. Acceptable values using this test are 400 grams per inch but values of 600 grams per inch and above are preferred.

Having thus described the present invention with reference to several embodiments it is to be understood that other changes and modifications may be made without departing from the invention as defined in the appended claims.

We claim:

1. A binding sheet for binding loose pages of known width and thickness together along one marginal edge comprising a sheet of material having two longitudinally extending edges, said edges being spaced from each other, at least one longitudinal edge of said sheet having a value of flexural rigidity of between $6\times10^{-3}$ to $5\times10^{-5}$ inch pounds, and a narrow band of adhesive coated on one surface of said sheet and along said at least one longitudinal edge, said band of adhesive having a width defined by the formula $$A_w=\pi t(N_{Max}+1)+T_{po}$$

where:

$A_w$=the adhesive width t=the known thickness of each page $N_{Max}$=a predetermined maximum number of pages to be bound on the sheet $T_{po}$=a predetermined minimum overlap of the adhesive on the marginal edge of the top page when binding the maximum number of pages.

2. A binding sheet according to claim 1 wherein the entire sheet has a flexural rigidity of between $6\times10^{-3}$ and $5\times10^{-5}$ inch pounds.

3. A binding sheet according to claim 2 wherein said sheet of material is a sheet of 20 pound Bond paper having a thickness of between 0.0036 and 0.0046 inch.

4. A binding sheet according to claim 1 wherein said band of adhesive is a normally tacky pressure-sensitive copolymer of iso-octyl acrylate and acrylic acid.

5. A binding sheet according to claim 1 wherein a removable liner is positioned to cover the band of adhesive.

6. A binding sheet according to claim 1 wherein said sheet of material is coated with a band of a low adhesion coating on said one surface of said sheet adjacent said band of adhesive.

7. A binding sheet according to claim 6 wherein said coating contains silicone.

8. A binding sheet according to claim 1 wherein a low adhesion coating is applied to said sheet of material on the surface opposite said one surface and band of adhesive.

9. A binding sheet according to claim 1 wherein the sheet of material has a width defined by the formula $$S_w=P_w+\pi tN_{Max}+T_{po}$$

wherein:

$S_w$=the sheet width $P_w$=the known page width.

10. A binding sheet according to claim 1 wherein said band of adhesive has a minimum adhesion value of:

Quick Stick=8 ounces per 0.5 inch

180° Shear=400 grams per inch, and

45° Peel=40 grams.

11. A pad of binding sheets for binding together along one marginal edge a plurality of loose pages each of a known width and thickness comprising a plurality of sheets of material each having at least one longitudinal edge having a value of flexural rigidity of between $6\times10^{-3}$ to $5\times10^{-5}$ inch pounds, a narrow band of adhesive coated on one surface of each of said sheets of material along said at least one longitudinal edge, said band of adhesive having a width defined by the formula $$A_w=\pi t(N_{Max}+1)+T_{po}$$

where:

$A_w$=the adhesive width t=the known thickness of each page $N_{Max}$=a predetermined maximum number of pages to be bound on each sheet $T_{po}$=a predetermined minimum overlap of the adhesive on the marginal edge of the top page when binding the maximum number of pages and a low adhesion coating on the surface of each of said sheets of material opposite said one surface and opposite said band of adhesive, said sheets being stacked one sheet above the other with the band of adhesive on one sheet in contact with said low adhesion coating on the adjacent sheet.

12. The method of binding a plurality of sheets of known width and thickness together comprising the steps of providing a binding sheet corresponding generally in size and shape to the sheets to be bound which binding sheet has a pressure sensitive adhesive coated on one surface thereof of along a marginal edge where the width of said adhesive along the marginal edge is defined by the formula $$A_w=\pi t(N_{Max}+1)+T_{po}$$

where:

$A_w$=the adhesive width t=the known thickness of each sheet to be bound $N_{Max}$=a predetermined maximum number of sheets to be bound on each binding sheet $T_{po}$=a predetermined minimum overlap of the adhesive on the marginal edge of the top sheet bound when binding the maximum number of sheets and where the stiffness of the coated marginal edge has a flexural rigidity of between $6\times10^{-3}$ and $5\times10^{-5}$ inch pounds, placing the binding sheet in alignmet with the sheets to be bound and against the last sheet of the sheets to be bound with said adhesive coated edge extending past the edges of said sheets to be bound together, clamping the aligned edges opposite said edges to be bound, folding the edges to be bound over the clamped edges to shingle the edges to be bound in a direction toward said marginal edge, and pressing said shingled edges against said adhesive.

13. The method according to claim 12 including the step of opening the first sheet of the sheets being bound to place the front face thereof against the adhesive at the marginal edge of the binding sheet.

* * * * *